US006733565B1

(12) United States Patent
Naro

(10) Patent No.: US 6,733,565 B1
(45) Date of Patent: May 11, 2004

(54) ADDITIVE FOR PRODUCTION OF IRONS AND STEELS

(76) Inventor: Rodney L. Naro, 19620 Edgecliff Dr., Euclid, OH (US) 44119

( * ) Notice: Subject to any disclaimer, the term of this patent is extended or adjusted under 35 U.S.C. 154(b) by 66 days.

(21) Appl. No.: 10/132,637

(22) Filed: Apr. 24, 2002

(51) Int. Cl.[7] ..... C21C 7/00

(52) U.S. Cl. ..... 75/562; 75/567; 75/568; 75/314; 75/315; 75/252

(58) Field of Search ..... 75/314, 315, 562, 75/567, 568, 252, 255, 303, 569

(56) References Cited

U.S. PATENT DOCUMENTS

| | | | | | |
|---|---|---|---|---|---|
| 804,785 | A | * | 11/1905 | Wedge | 75/319 |
| 2,272,277 | A | * | 2/1942 | Ramsey et al. | 420/87 |
| 2,501,138 | A | * | 3/1950 | Parker | 420/87 |
| 2,780,541 | A | * | 2/1957 | Zifferer | 420/21 |
| 3,421,886 | A | | 1/1969 | Schelleng | |
| 3,798,027 | A | | 3/1974 | Defranco et al. | |
| 4,152,150 | A | * | 5/1979 | Frantzreb, Sr. | 75/303 |
| 4,390,362 | A | | 6/1983 | Khusnutdinov et al. | |
| 5,008,074 | A | | 4/1991 | Naro et al. | 420/578 |
| 5,100,612 | A | | 3/1992 | Obata et al. | 420/13 |
| 5,268,141 | A | | 12/1993 | Ototani et al. | 420/8 |
| 6,102,983 | A | | 8/2000 | Skaland | 75/568 |
| 6,293,988 | B1 | | 9/2001 | Naro | 75/300 |

OTHER PUBLICATIONS

R.L. Naro and J.F. Wallace, "Minor Elements In Gray Iron, Background for the Development of a non–Ferrosilicon based Inoculant," Report of Research Project, AFS Gray Iron Division, American Foundrymen's Society (1970).

* cited by examiner

*Primary Examiner*—Ngoclan T. Mai
(74) *Attorney, Agent, or Firm*—Renner, Otto, Boisselle & Sklar, LLP

(57) ABSTRACT

A technique for producing compacted graphite iron utilizes agglomerations, such as briquettes or tablets that include a sulfur-containing material such as iron sulfide. The agglomerations are free of chemical binders and utilize iron and aluminum metal powders and pressure for compaction on either roll presses or tablet machines. Addition of metal powders provides rapid dissolution of the alloy and improved heat transfer. Iron sulfide agglomerations also provide consistent and improved sulfur recoveries compared to granulated iron sulfide additions with little to no sulfur odor.

36 Claims, No Drawings

ADDITIVE FOR PRODUCTION OF IRONS AND STEELS

BACKGROUND OF THE INVENTION

1. Technical Field of the Invention

The invention relates to production of irons and steels, and additives used in such production.

2. Description of the Related Art

Irons with compacted graphite microstructures can provide numerous economies in many industrial applications. They can provide the strength characteristics of ductile irons along with the thin section casting capability of gray irons. Castings made from irons containing graphite with "a compacted shape" can be made much thinner than normal gray cast irons and approach the weight savings offered by aluminum castings. At the same time, such castings have a higher modulus, higher strengths, excellent dampening properties and wear resistance. Difficulties in controlling the microstructure has prevented wide spread conversion to these irons.

Cast Irons

It is generally recognized that there are three distinct classes of cast irons. The first class of cast irons is gray iron. The usual microstructure of gray iron is a matrix of ferrite and pearlite with graphite flakes dispersed throughout. It is called gray iron because when it fractures, the color of the fracture is gray. When gray iron, which is quite brittle, is broken, the fracture propagates through an interconnected network of graphite flakes, hence giving rise to a grayish colored fracture. This network of interconnecting graphite flakes imparts some unique characteristics to gray cast irons; the flake structure provides excellent damping properties, a high level of thermal conductivity and excellent machining capabilities.

A second class of cast irons is ductile irons. In ductile irons, the usual microstructure is a matrix of ferrite and pearlite with the graphite now in the form of graphite nodules or spheroids dispersed throughout the structure. Since the graphite is now in the shape of individual graphite spheres, without the interconnecting and weakening effect of flake graphite, tensile strengths are double to triple that of gray cast irons. The irons have significant improved ductility and impact properties. Ductile irons are used in many applications requiring high strength and ductility.

Compacted graphite irons (CG) are a relative newcomer to the family of cast irons. These irons exhibit tensile strengths almost comparable to ductile iron while exhibiting the castability of gray iron. The structure is characterized by graphite particles intermediate in shape between the flake graphite of gray iron and the spheroidal form of graphite in ductile iron. However, the unique combination of properties in CG irons give these irons a number of significant advantages in a variety of applications over both gray and ductile iron.

The CG shape has been known for some time and has also been called quasi flake, semi-nodular and vermicular graphite. Its production is similar to that of ductile iron in requiring close metallurgical control, but it is far more difficult to produce than ductile iron and requires extremely close metallurgical control. It is extremely important to minimize or eliminate formation of spherulitic graphite forms. The physical and mechanical properties of CG irons are to a large extent related to the interconnected graphite phase. While individual properties are generally intermediate to those of gray and ductile cast iron, some of the better properties of both gray and ductile iron are combined in CG irons.

Strength properties of CG irons can be adjusted by using the same alloys that are commonly used in ductile iron. Tensile strengths of CG irons are equal to or greater than those of alloyed high strength gray cast irons, and tensile and yield strengths approach those of ductile cast irons. Tensile strengths of 50,000 to 75,000 psi and yield strengths of 35,000 to 60,000 psi have been reported for as cast CG irons. Elongation values vary from 1% to 6% for the higher and lower strength CG irons, respectively.

The thermal conductivity of CG is intermediate between gray and ductile cast iron. The thermal conductivity and camping capacity of CG irons of near eutectic compositions are comparable, however, to the thermal conductivity and damping capacity of lower carbon equivalent high strength gray cast irons. Impact properties of CG irons are substantially better than gray cast irons although lower than ductile iron.

Because the graphite in CG is interconnected, the machinability of CG irons is appreciably better than the machinability of ductile cast irons. Because CG iron castings can be poured from higher carbon equivalent irons, they are less susceptible to chill and carbide formation than are high strength gray irons.

Production of CG Irons

Early in the identification of the structure of CG irons, process control difficulties have made the commercial production of these irons impractical if not impossible for some foundries. Thus, CG irons have not realized their true potential.

Early research in developing a procedure for the commercial production of CG irons showed that its manufacture was not a situation where a producer under-treated molten ductile irons by employing reduced magnesium levels. This under-treatment method targeted a residual magnesium level of 0.017 to 0.021%. Magnesium variations of as little as 0.005% could mean the difference between containing CG iron and failure. Great difficulties were encountered in achieving consistently good structures because it is extremely difficult to control the magnesium reaction in molten cast irons (magnesium boils at just above 1,994° F., which is far below the processing temperatures used in making cast irons). Hence, it was difficult to operate within this narrow window of magnesium concentration needed for CG iron formation. Nevertheless, this method is still used by some producers of nodular graphite cast iron.

Other treatment methods incorporating rare earths have not met with success because of the tendency for rare earth treated irons to be susceptible to carbide or chill formation.

A substantial amount of the total tonnage of CG irons is produced using magnesium ferrosilicon master alloys containing titanium and rare earths or magnesium ferrosilicon master alloys with small additions of titanium. See, e.g., U.S. Pat. No. 3,421, 886. This method for producing CG irons widens the magnesium window for CG formation, and utilizes a 5% magnesium ferrosilicon master alloy containing 8.5 to 10.5% titanium, 4.0 to 5.5% calcium, 1.0 to 1.5% aluminum, 0.20 to 0.35% cerium, 48.0 to 52.0% silicon, the balance being iron. The treatment of the liquid iron with this master alloy is done in a similar way to the treatment of regular ductile iron with 5% magnesium ferrosilicon. This means that sandwich, plunging, or open ladle methods are applicable. As with nodular cast iron, a ladle inoculation is necessary. The composition of the melt should be near eutectic, and the sulfur content should not exceed 0.035%. The compositions utilized may vary according to the treatment method, type of ladle, sulfur-content of the base iron, and treatment temperature.

Although this method of using magnesium ferrosilicon master alloys containing titanium as ladle additions has been used for almost 25 years, in actual practice, there is considerable concern about titanium contamination stemming from residual titanium in casting gates and risers that are subsequently used for re-melting. Since many potential CG iron foundries also pour ductile iron, the presence of unwanted titanium from titanium containing master alloys can be the source of considerable scrap ductile iron castings due to titanium contamination. Titanium carryover from CG production will ruin the properties of ductile iron. Hence, these concerns have prevented large-scale conversions to CG irons.

To eliminate the need for titanium bearing master alloys, with recent developments in computer aided thermal analysis of cooling molten iron, it was now possible to achieve improved control over magnesium levels. Although the use of these relatively sophisticated thermal analysis techniques has made it somewhat easier to control residual magnesium levels, control of the metal temperature is also critically important. Preliminary magnesium treatment for initial treatment of CG molten metal may involve several processes. Final control of magnesium is accomplished after thermal analysis by the injection of magnesium containing wire into molten iron. Magnesium wire injection along with these newly developed thermal analysis techniques has made production of CG irons somewhat easier and more consistent. A drawback to the process is the cost of the equipment and royalty payments to the software developer.

More recently, it has been demonstrated that the controlled additions of the element sulfur can now provide another option for producing CG iron. Using sulfur to "de-nodularize" the liquid iron widens the window and the chemistry ranges over which CG will form. Still, it is essential to control the range of magnesium used in the process. Keeping the magnesium level initially in the range of 0.03% to 0.04% with a base sulfur content of 0.01% has proven to be most desirable. By having knowledge of the residual magnesium, it is possible to de-nodularize the iron and promote CG growth by adding sulfur to the molten iron. Since the newly added sulfur reacts rapidly with the residual magnesium, it is possible to reduce the magnesium level to the desirable range or window where CG forms. Ranges of magnesium between 0.015 to 0.032% and sulfur between 0.015 to 0.024% have proven to produce acceptable grades of CG.

This new process, utilizing sulfur as a controlled addition, allows for a broad range of final magnesium and sulfur contents. It has been found that acceptable microstructures can be obtained with higher magnesium levels ranging up to 0.032% accompanied with sulfur residuals of 0.024%. Recent findings have also shown that proper CG structures can be obtained with magnesium levels of 0.033% and sulfur levels of 0.024%. These controlled sulfur additions, may also have an effect on the growth phase of graphite nucleating from the cooling molten metal. Researchers have known for some time that sulfur is a surface-active element in cast irons and may alter the growth and shape of graphite. Hence, it is very likely that these controlled additions of sulfur alter the growth mode of graphite so as to form compacted shapes of graphite in the metal.

SUMMARY OF THE INVENTION

A technique for producing compacted graphite iron utilizes agglomerations, such as briquettes or tablets, that includes a sulfur-containing material such as iron sulfide. The agglomerations are free of chemical binders and utilize iron and aluminum metal powders and pressure for compaction on either roll presses or tablet machines. Addition of metal powders provides rapid dissolution of the alloy and improved heat transfer. Iron sulfide agglomerations also provide consistent and improved sulfur recoveries compared to granulated iron sulfide additions with little to no sulfur odor.

According to an aspect of the invention, an agglomeration additive for iron and steel production consists essentially of a sulfur-containing material and a mechanical binder.

According to another aspect of the invention, an agglomeration additive for iron and steel production consists essentially of sulfur, aluminum, and iron.

According to yet another aspect of the invention, an agglomeration additive for iron and steel production includes a metal-sulfur compound and a metal powder binder.

According to a further aspect of the invention, a method of re-sulfurizing iron, includes forming molten base iron; and adding an agglomeration to the base iron. The agglomeration includes a metal-sulfur compound and a metal powder binder.

To the accomplishment of the foregoing and related ends, the invention comprises the features hereinafter fully described and particularly pointed out in the claims. The following description sets forth in detail certain illustrative embodiments of the invention. These embodiments are indicative, however, of but a few of the various ways in which the principles of the invention may be employed. Other objects, advantages and novel features of the invention will become apparent from the following detailed description of the invention.

DETAILED DESCRIPTION

An iron sulfide tablet or briquette may be used to re-sulfurize molten cast irons or steels. Because soft metal binders, with high thermal conductivity are used in the tablet or briquette, dissolution is very rapid.

Agglomeration additives described in detail below are highly useful in producing cast irons with a compacted graphite (CG) structure in an effective, economical and efficient manner. The term "agglomeration," as used herein, is defined to include unitary solids, such as tablets or briquettes, in contrast to powderized or granular materials. The agglomerations are formed by combining and blending of sulfur compounds, for example iron sulfide, with mechanical binders such as metal powders, which are in turn used to fabricate high density briquettes or tablets of the same sulfur-containing combination. The fabricated agglomerations can be used as a direct addition to the molten cast irons to produce CG irons. These agglomerations (also referred to herein as "iron sulfide briquettes") may also be used as direct additions to steels for re-sulfurization, to ductile irons to revert the same iron back to gray iron, and to gray cast irons for re-sulfurization. An important use for the agglomeration additives is for the production of CG irons using a sulfur addition method.

Agglomerations such as those described below provide consistent and high recoveries of the element sulfur to molten irons. Such agglomerations advantageously dissolve immediately when added to molten irons, thereby providing consistent sulfur recoveries.

Agglomeration additives described in detail below include a sulfur-containing material and a mechanical binder. The sulfur-containing material may include metal-sulfur compound. An example of a suitable metal-sulfur compound is iron sulfide (iron pyrite).

The metal binder may include a metal powder. The metal powder may include one or more metal powders selected from the group consisting of iron powder, aluminum powder, and copper powder. An example of suitable iron powder is iron powder having a particle size distribution of −30 to +200 mesh. An example of suitable aluminum powder is aluminum powder having a particle size distribution of −20 to +200 mesh. Metal powders advantageously have a high thermal conductivity, enabling rapid dissolution of the agglomeration additive in molten iron.

Agglomerations of the present invention may be produced on a high-pressure press or roll briquette press. Iron powder may be used as the primary "carrier" and densification agent. The iron powder provides improved specific gravity and heat transfer for improved alloy dissolution. The iron powder provides a source of 'mechanical particle interlocking' that assists in the consolidation of the alloy ingredients into a tablet that possesses outstanding green handling properties. Use of iron as the "carrier" agent eliminates the need for chemical bonding agents. Aluminum granules or aluminum powder may also be used as a secondary binding agent, for example to provide another source of heat transfer which aids in dissolution or increases the melting rate of the iron sulfide briquette.

It has been found that control of final sulfur levels in CG iron production can advantageously be accomplished by adding briquetted iron pyrites to magnesium treated molten irons. The amount of sulfur that needs to be added is determined by knowing the sulfur content of the base metal as well as the residual magnesium level. The stoichiometric amount of sulfur needed to reduce magnesium to the range necessary for CG formation can then be easily calculated. Using granulated iron pyrites disadvantageously results in erratic and inconsistent sulfur recoveries since the powdered pyrites are difficult to get under the surface of the metal. Further, because of superheated convection currents, the powder may become airborne and sticks to the ladle or furnace walls and generate foul smelling sulfide gases. Iron to sulfide briquettes bonded with chemical binders, either organic or inorganic, are not suitable since they do not dissociate or dissolve rapidly enough to be used in foundry melting applications, where rapid dissolution is a requirement. Iron sulfide briquettes bonded with soft metals and high pressures solve these problems and provide for consistent sulfur recoveries with little to no odor.

Although the principal use for agglomerations described herein is for the production of CG irons, they can also be used for controlled additions of sulfur to both all classes of irons as well as steels.

In the processing of ductile iron, there are certain times when it may be advantageous to re-sulfurize ductile iron for the conversion to gray iron. The sulfur contained in the briquettes combines with residual magnesium in the ductile iron. The elimination of residual magnesium converts the molten iron to normal gray iron. The conversion process of ductile to gray iron, if used, must occur very rapidly, and briquettes bonded with "matrix" or "film" chemical binders such as cement or sodium silicate will not dissolve with necessary speed required. For example, sodium silicate, a relatively inexpensive binder commonly used for certain types of ferroalloy briquettes, upon immersion into molten irons, first undergoes a transformation to a "glass phase", actually retarding the dissolution rate of the briquette, before it softens and then allows the briquette to heat up and slowly dissolve. Organic binders, such as those used for bonding sand, can also be used to bond ferroalloy briquettes. However, these binders first develop high temperature carbon or coke bonding when immersed in molten irons. This again retards the dissolution of the alloy. Ferroalloy briquettes bonded with blends of iron powder and aluminum powders or granules actually provide increased heat transfer to assist in the dissolution of the briquette.

A specific embodiment agglomeration additive is made with varying blends of iron pyrites, iron powder and aluminum powder blended to form a mixture having 30 to 40% sulfur, 1.4 to 16.0% aluminum, the balance being iron and incidental impurities, Percentages given herein are percentages by weight.

Another specific embodiment is an agglomeration additive having about 30% sulfur, about 12.35% aluminum, the balance being iron and incidental impurities.

Testing of the iron sulfide tablets or briquettes in the production of compacted graphite irons (CG iron) has shown that CG iron may form over a broader band of residual magnesium levels compared with using just magnesium wire injection in conjunction with sophisticated, computerized thermal analysis process. This method also allows for production of CG alloys without the need for titanium containing master alloys.

Production of CG irons having the composition 3.7 to 3.9% carbon, 1.8 to 2.0% silicon, 0.20 to 0.40% manganese, 0.035% residual magnesium and 0.01% sulfur can be accomplished by adding agglomerations such as those described above. Adding 0.015% sulfur as an agglomeration containing 30% sulfur, reduces the magnesium level to 0.018% with a corresponding sulfur level of 0.014%. The structure of the resulting CG iron was 80% compacted graphite with 20% nodularity. Excellent results have also been obtained used even higher base magnesium levels. In another instance, residual magnesium of the base iron was 0.045%. The addition of the stoichiometric amount of sulfur from a 30% iron sulfide briquette to a high residual magnesium base iron (0.045% magnesium), reduced the magnesium level to 0.032%, the final iron having a residual sulfur content of 0.024%. Thus using agglomerations such as those described above, high residual magnesium base irons (having magnesium levels of at least 0.040%) may be used to produce CG iron. This performance could not be accomplished by just adding iron sulfides (as iron pyrites) to an open treatment ladle. Further, the generation of large volumes of hydrogen sulfide and other sulfurous gases may be avoided by using agglomerations such as those described above.

Although the invention has been shown and described with respect to a certain embodiment or embodiments, it is obvious that equivalent alterations and modifications will occur to others skilled in the art upon the reading and understanding of this specification. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An agglomeration additive for iron and steel production, consisting essentially of:

a sulfur-containing material; and a mechanical binder.

2. The agglomeration of claim 1, wherein the mechanical binder includes an uncompounded metal powder.

3. The agglomeration of claim 1, wherein the mechanical binder includes one or more uncompounded metal powders selected from the group consisting of iron powder, aluminum powder, and copper powder.

4. The agglomeration of claim 3, wherein the mechanical binder includes iron powder.

5. The agglomeration of claim 4, wherein the mechanical binder also includes aluminum powder.

6. The agglomeration of claim 5, wherein the agglomeration includes at least 30% by weight sulfur, and at least 1.5% by weight aluminum, the balance being iron and incidental impurities.

7. The agglomeration of claim 6, wherein the agglomeration includes no more than 40% by weight sulfur and no more than 16% weight aluminum.

8. The agglomeration of claim 7, wherein the agglomeration includes about 30% by weight sulfur and about 12% by weight aluminum.

9. The agglomeration of claim 1, wherein sulfur-containing material includes a sulfur-metal compound.

10. The agglomeration of claim 1, wherein the sulfur-containing, material includes iron sulfide.

11. An agglomeration additive for iron and steel production, consisting essentially of sulfur, aluminum, and iron.

12. The agglomeration of claim 11, wherein the agglomeration includes iron sulfide.

13. The agglomeration of claim 12, wherein the agglomeration includes iron powder.

14. The agglomeration of claim 13, wherein the agglomeration includes aluminum powder.

15. The agglomeration of claim 14, wherein the agglomeration is 30 to 40% sulfur by weight and 1.5 to 16% aluminum by weight, with the balance being iron and incidental impurities.

16. An agglomeration additive for iron and steel production, comprising:

a metal-sulfur compound; and an uncompounded metal powder binder.

17. The agglomeration of claim 16, wherein the metal-sulfur compound includes iron sulfide.

18. The agglomeration of claim 16, wherein the metal powder binder includes one or more metal powders selected from the group consisting of iron powder, aluminum powder, and copper powder.

19. The agglomeration of claim 16, wherein the metal powder binder includes iron powder.

20. The agglomeration of claim 19, wherein the metal powder binder also includes aluminum powder.

21. The agglomeration of claim 20, wherein the metal-sulfur compound includes iron sulfide.

22. A method of re-sulfurizing iron, comprising:

forming a molten base iron; and adding an agglomeration to the base iron;

wherein the agglomeration includes:

a metal-sulfur compound; and an uncompounded metal powder binder.

23. The method of claim 22, wherein the agglomeration consists essentially of the metal-sulfur compound and the metal powder binder.

24. The method of claim 22, wherein the molten base iron has a magnesium level of at least 0.040%.

25. An additive for iron and steel production, consisting essentially of sulfur, aluminum, and iron.

26. The additive of claim 25, wherein the additive includes iron sulfide.

27. The additive of claim 26, wherein the additive includes iron powder.

28. The additive of claim 27, wherein the additive includes aluminum powder.

29. The additive of claim 28, wherein the additive 30 to 40% sulfur by weight and 1.5 to 16% aluminum by weight, with the balance being iron and incidental impurities.

30. An agglomeration additive for iron and steel production, comprising:

a sulfur-containing material; and a mechanical binder.

31. The agglomeration of claim 30, wherein the mechanical binder includes an uncompounded metal powder.

32. The agglomeration of claim 30, wherein the mechanical binder includes one or more uncompounded metal powders selected from the group consisting of iron powder, aluminum powder, and copper powder.

33. The agglomeration of claim 32, wherein the mechanical binder includes iron powder.

34. The agglomeration of claim 33, wherein the mechanical binder also includes aluminum powder.

35. The agglomeration of claim 30, wherein sulfur-containing material includes a sulfur-metal compound.

36. The agglomeration of claim 30, wherein the sulfur-containing material includes iron powder.

* * * * *